United States Patent [19]

Eberle

[11] 4,091,986

[45] May 30, 1978

[54] CONTAINER HAVING IMPROVED FILLING VALVE

[75] Inventor: Robert T. Eberle, Monroe, La.

[73] Assignee: Olinkraft, Inc., West Monroe, La.

[21] Appl. No.: 793,721

[22] Filed: May 4, 1977

[51] Int. Cl.[2] ..... B65D 31/14

[52] U.S. Cl. ..... 229/62.5

[58] Field of Search ..... 229/62.5; 150/9

[56] References Cited

U.S. PATENT DOCUMENTS

| | | | |
|---|---|---|---|
| 3,216,647 | 11/1965 | Arnold | 229/62.5 |
| 3,318,511 | 5/1967 | Winegard | 229/62.5 |

FOREIGN PATENT DOCUMENTS

| | | | |
|---|---|---|---|
| 806,623 | 4/1951 | Germany | 229/62.5 |
| 1,954,360 | 5/1971 | Germany | 229/62.5 |

*Primary Examiner*—Stephen P. Garbe

*Attorney, Agent, or Firm*—O'Brien and Marks

[57] ABSTRACT

An industrial container or bag is disclosed as having a filling valve for particulate materials, which valve is an effective seal following a filling operation and which valve is flexibly mounted to preclude its rupture during the filling operation.

7 Claims, 4 Drawing Figures

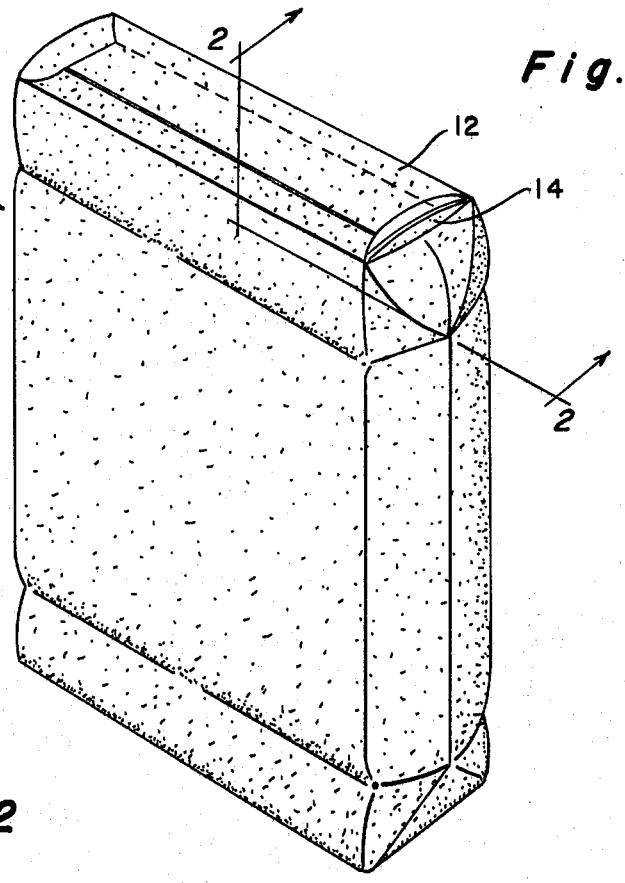
Fig. 1
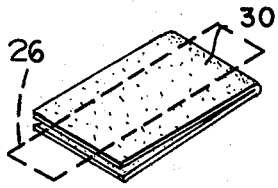
Fig. 3
Fig. 2
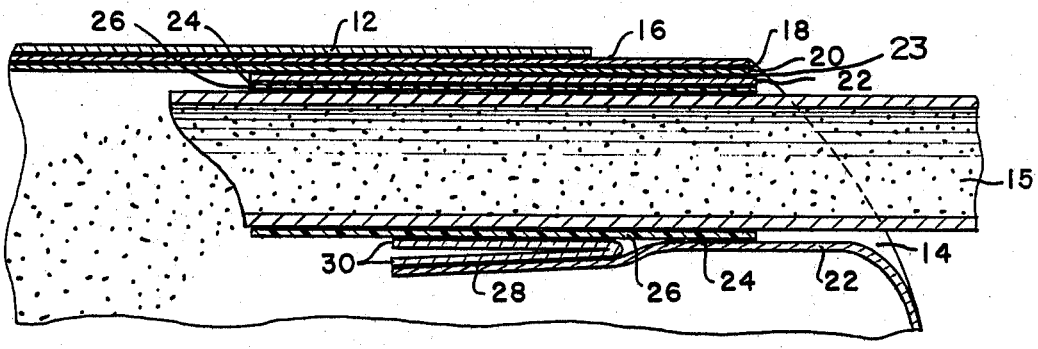
Fig. 4
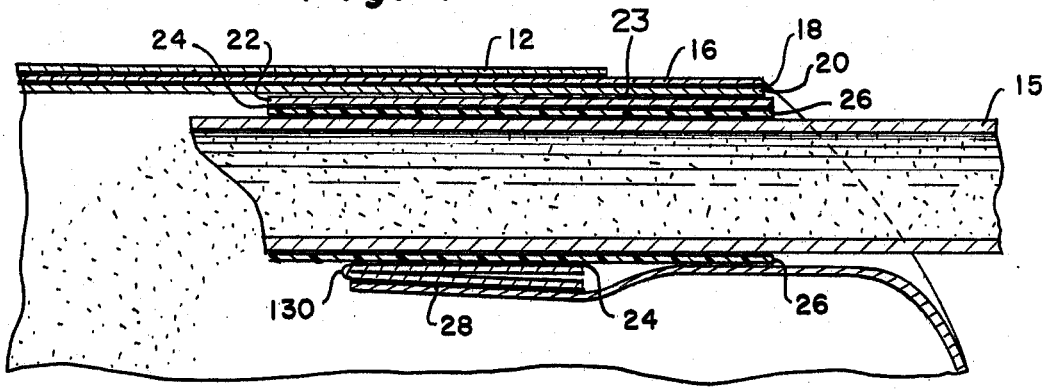

CONTAINER HAVING IMPROVED FILLING VALVE

BACKGROUND OF THE INVENTION

1. Field of the Invention

The present invention relates to a container for particulate material, and, more particularly, to such a container having a filling valve with an effective seal for containing the particulate material.

2. Description of the Prior Art

The prior art, as exemplified by U.S. Pat. Nos. 2,189,847, 3,216,647, 3,894,682 and 3,904,107 is cognizant of multiwall paper bags formed with a filling valve for the insertion of particulate material. Such an industrial bag is shown in U.S. Pat. No. 3,216,647 wherein a tube of thermoplastic film is collapsed after filling for sealing purposes.

A particular problem associated with the prior art devices is that of tearing of the thermoplastic film during the filling operation due to the weight of the contents as well as the separation of thermoplastic film from the adjacent portions of the bag.

SUMMARY OF THE INVENTION

The present invention is summarized in that an industrial container includes a multiwall bag having an end closure, a filling entry in the end closure, a paper tube extending from the entry into the bag, a thermoplastic sleeve extending through the paper tube and being adapted to receive a filling nozzle, means securing an upper portion of the thermoplastic sleeve to an adjacent portion of the paper tube, and flexible means secured between a lower portion of the thermoplastic sleeve and an adjacent portion of the paper tube whereby the thermoplastic sleeve is secured from tearing.

An object of the present invention is to preclude tearing of the thermoplastic sleeve of a filling valve in an industrial bag.

This invention has another object in that a flexible hinge secures a filling valve in an end enclosure of a multiwall bag.

Yet another object of the present invention is to construct a bag filling valve which prevents the contents of the container from being contaminated by environmental contaminates or alternatively from being expelled from the container even under internal bag pressure conditions.

A yet additional object of the present invention is to provide a simple inexpensive valve closure means which functions to fill an industrial container with particulate material and which effectively serves to contain the filling opening automatically after the container is filled.

Other and additional objects and advantages of the present invention will become apparent from the following description of the preferred embodiments taken in conjunction with the accompanying drawings.

BRIEF DESCRIPTION OF THE DRAWINGS

FIG. 1 is a perspective view of a filled industrial bag embodying the present invention.

FIG. 2 is a partial cross section taken substantially along the line 2—2 of FIG. 1.

FIG. 3 is a perspective view of a detail of FIG. 2 with a part superimposed thereon.

FIG. 4 is a partial cross section similar to FIG. 2 but showing an alternate arrangement.

DESCRIPTION OF THE PREFERRED EMBODIMENT

As is illustrated in FIG. 2, the industrial container 10 is a multiwall bag and its end closure 12 is formed with an entry pocket or opening 14. A paper gusset is constructed in the opening 14 by two layers of paper 16 and 20 which are secured together as by glue 18. A paper tube 22 has its upper portion partially secured to the paper layer 20 as by glue 23 which extends only on the outer half of the tube's upper portion.

A sleeve 26 has a thin flexible, seamless construction and is collapsible when the nozzle 15 is removed therefrom. The sleeve 26 may be made of paper or a thermoplastic resin. The thermoplastic resin may be a polyolefin generally, for example, polyethylene, polypropylene, copolymers of polyethylenepolypropylene either blocked or random, plasticized vinyl chloride polymers and copolymers, and plasticized vinylidene chloride polymers. Numerous additional readily available polymers having equivalent properties to that of the defined polyolefins are also readily applicable herein.

As is apparent in FIG. 2, the upper portion of sleeve 26 is secured to the adjacent upper portion of paper tube 22 as by glue 24. Sleeve 26 is generally cylindrical in configuration and the glued upper portion constitutes a semi-cylindrical portion, the longitudinal dimension of which is secured by the glue 24. Adjacent the lower portion, sleeve 26 has its semi-cylindrical portion secured to the lower portion of paper tube 22 by the same glue 24 since the glued sleeve portions are cylindrical adjacent the entry 14; the longitudinal dimension of these cylindrical portions is approximately one-fourth of the length of the sleeve 26.

In the construction of FIG. 2, the sleeve 26 has an intermediate lower portion secured as by the glue 24 to the top surface of a flexible hinge 30. Since the flexible hinge 30 has a width greater than such intermediate lower portion of the sleeve 26, the sleeve 26 is longitudinally centered on the hinge 30, (see FIG. 3). The hinge 30 is formed from flexible material, such as paper, which is folded into a generally V-shaped configuration. The bottom surface of the hinge 30 is secured as by glue 28 to the adjacent portion of the paper tube 22 with the opened part of the V-shaped configuration facing away from the entry 14.

In the arrangement shown in FIG. 4, the components are identical in structure to those described above in connection with FIGS. 1–3 and are not being described again for the sake of brevity. The FIG. 4 arrangement differs from FIGS. 1–3 in that the flexible hinge 130 has the opened part of its V-shaped configuration facing toward the entry 14.

The flexible hinge in FIGS. 1–4 has the particular advantage of preventing tearing of the bond at the entry end of the bag 10 during the filling operation. The problem of failure of the adhesive between the sleeve 26 and entry pocket is alleviated by the hinge which adds flexibility to the construction.

During a bag filling operation, the nozzle 15 is disposed through the sleeve 26 whereby particulate matter, for example, cement, is forced into the interior of the bag 10. As the bag is being filled, the weight increases and, in the prior art devices, causes a tearing of the thermoplastic film forming the sleeve 26 and/or causes a separation of the lower portion of the paper tube 22 from sleeve 26. In accordance with the present invention, such tearing and/or separation is precluded because the flexible hinge provides additional support for mounting the sleeve 26.

As is apparent from FIGS. 2–4, the interior end of the thermoplastic sleeve 26 projects beyond the hinge 30 (and 130) so that after the filling operation, the nozzle 15 is removed, the industrial bag 10 is inverted whereby the weight of its contents bears against the interior end of the sleeve 26 and against the lower portion of the paper tube 22 causing the collapse and effective sealing of the entire sleeve 26.

Inasmuch as the present invention is subject to many modifications, changes in details and reversal of parts, it is intended that all matter contained in the foregoing description or shown on the accompanying drawing shall be interpreted as illustrative and not in a limiting sense.

What is claimed is:

1. An industrial container comprising a multiwall bag having an end closure, a filling entry in said end closure, means defining a paper tube extending from said entry to an interior portion of said bag, a sleeve extending through said paper tube and adapted to receive a filling nozzle, means securing an upper portion of said sleeve to an adjacent portion of said paper tube, and a flexible hinge element having first and second superimposed parts with the first part secured to a lower portion of said sleeve and the second part secured to an adjacent portion of said paper tube, said flexible hinge element providing additional support for said sleeve whereby said sleeve is secured from tearing during a nozzle filling operation which increases the weight of material in the bag.

2. An industrial container as claimed in claim 1 wherein the hinge element has a generally V-shaped configuration.

3. An industrial container as claimed in claim 2 wherein the securing means is glue.

4. An industrial container as claimed in claim 2 wherein said V-shaped hinge element has an opened end facing toward said entry.

5. An industrial container as claimed in claim 2 wherein said V-shaped hinge element has an opened end facing away from said entry.

6. An industrial container as claimed in claim 2 wherein said sleeve comprises a thermoplastic which is made of polyethylene and has an interior end projecting beyond said V-shaped hinge element into the interior portion of said bag.

7. An industrial container as claimed in claim 2 wherein said sleeve is made of paper.

* * * * *